US008415580B2

(12) United States Patent
Schaltenbrand et al.

(10) Patent No.: US 8,415,580 B2
(45) Date of Patent: Apr. 9, 2013

(54) CARRIER LINK INSULATOR FOR A CIRCUIT BREAKER

(75) Inventors: Brian John Schaltenbrand, Pittsburgh, PA (US); Mark Anthony Janusek, Pittsburgh, PA (US); Robert William Mueller, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 68 days.

(21) Appl. No.: 13/172,959

(22) Filed: Jun. 30, 2011

(65) Prior Publication Data

US 2013/0001202 A1 Jan. 3, 2013

(51) Int. Cl.
*H01H 33/02* (2006.01)

(52) U.S. Cl.
USPC ..... 218/154; 218/7

(58) Field of Classification Search ..... 218/14–21, 218/29, 30, 34–40, 147–158; 335/201
See application file for complete search history.

(56) References Cited

U.S. PATENT DOCUMENTS 5,924,554 A * 7/1999 Dosmo et al. ..... 218/154
8,183,490 B2 * 5/2012 Gibson et al. ..... 218/147
2007/0268100 A1 * 11/2007 Schaltenbrand et al. ..... 335/201

* cited by examiner

*Primary Examiner* — Tulsidas C Patel
*Assistant Examiner* — Marina Fishman
(74) *Attorney, Agent, or Firm* — Eckert Seamans Cherin & Mellott, LLC

(57) ABSTRACT

A carrier link insulator electrically insulates a carrier drive link from an arc chamber in a circuit breaker.

8 Claims, 7 Drawing Sheets

CARRIER LINK INSULATOR FOR A CIRCUIT BREAKER

BACKGROUND

Electrical switching apparatus for power distribution systems include devices such as circuit breakers, network protectors, transfer switches and disconnect switches. A common type of circuit breaker is the air circuit breaker, which uses a flow of gas to extinguish the arc caused by separation of the contacts. The flow of gas may be provided by a source of compressed gas or by air exiting a sealed arc chamber that is pressurized when the contacts separate. When the circuit breaker contacts are closed, a portion of the drive linkage that actuates the contact separation mechanism may be positioned within the arc chamber. Thus arcing that occurs during separation may electrically contact the drive linkage, creating a potential short circuit condition.

SUMMARY

In one embodiment, an apparatus includes a contact carrier configured to be actuated by a carrier drive link to carry one or more moveable contacts along an excursion between a contact closed position in which the moveable contacts electrically contact corresponding stationary contacts and a contact open position in which the moveable contacts do not contact the corresponding stationary contacts. The contact carrier includes a carrier housing and a carrier link insulator. The carrier housing is configured to house the carrier drive link, the carrier housing further comprising a front face that is positioned within an arc chamber during at least a portion of the carrier excursion. The carrier link insulator is coupled to the carrier housing. The carrier link insulator includes an electrically insulating material and is being located in an arc path between the arc chamber and the carrier drive link.

In one particular embodiment, the carrier link insulator is an insulator plug configured to be press fit in an opening in the carrier housing front face. The insulator plug includes a plug front face that is substantially flush with the carrier housing front face when the insulator plug is fitted into the carrier housing. The insulator plug may also include a notched flat front portion and a U-shaped portion in which the U-shaped portion is positioned midway within a notch in the notched flat front portion and is configured to be positioned around at least a portion of the carrier drive link. The U-shaped portion may include a front face that aligns flush with a front face of the notched flat front portion to form the plug front face and extends above the front face of the notched flat front portion so that the plug front face abuts a circuit breaker housing the forms part of the arc chamber throughout the excursion.

In another embodiment, the carrier link insulator includes a flexible barrier made of dielectric material coupled to the carrier drive link and configured to flex when the drive line moves the contact carrier.

BRIEF DESCRIPTION OF THE DRAWINGS

The accompanying drawings, which are incorporated in and constitute a part of the specification, illustrate various example systems, methods, and other embodiments of various aspects of the invention. One of ordinary skill in the art will appreciate that in some embodiments one element may be designed as multiple elements, multiple elements may be designed as one element, an element shown as an internal component of another element may be implemented as an external component and vice versa, and so on. Furthermore, elements may not be drawn to scale.

DETAILED DESCRIPTION

Figure 1:
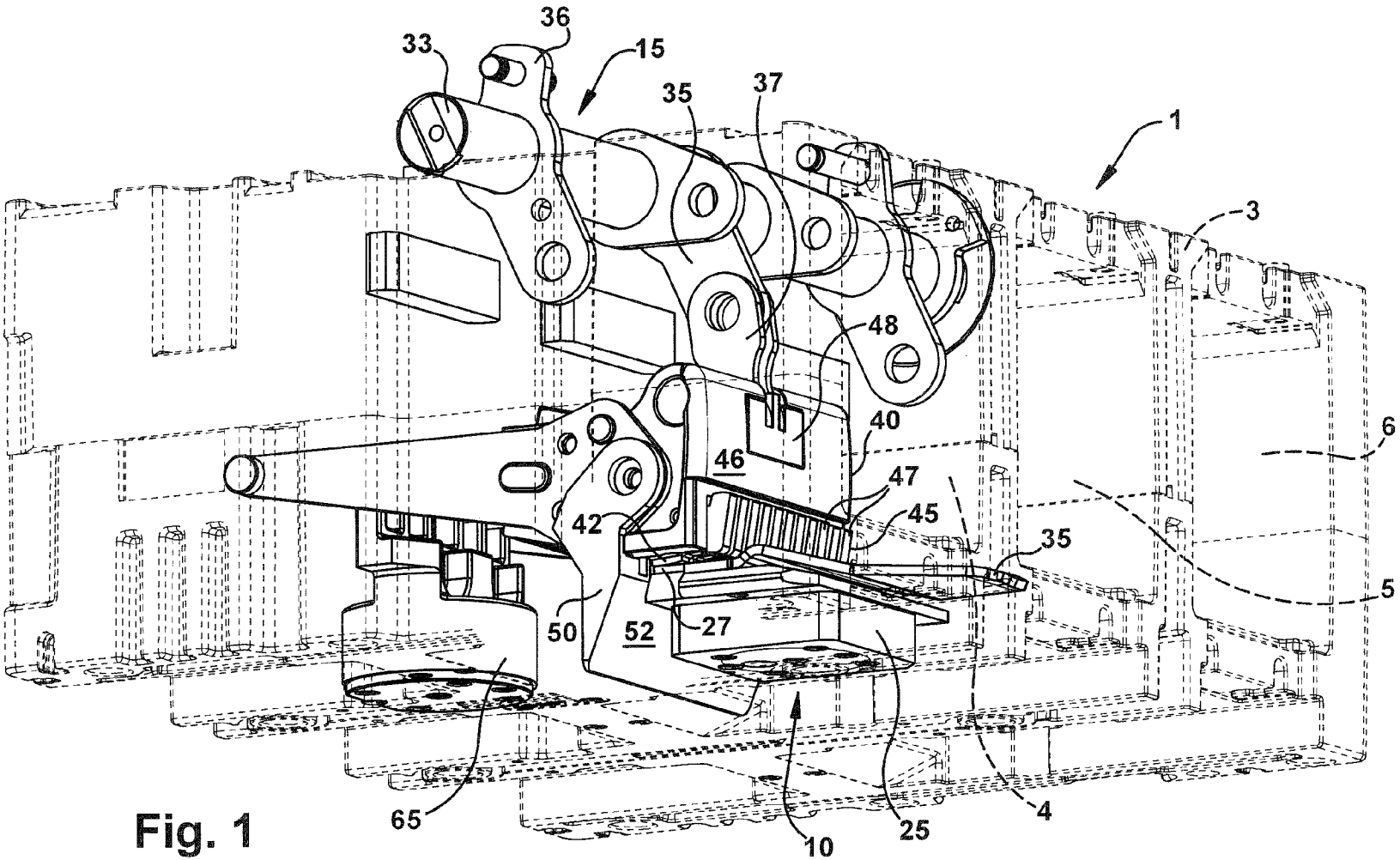
FIG. 1 illustrates a three pole air circuit breaker that includes one embodiment of a carrier link insulator.

An air circuit breaker 1 is illustrated in FIG. 1. The air circuit breaker includes a housing 3 (shown in dashed line) that forms three pole chambers 4, 5, 6, each configured to house a circuit breaker pole 10 (only one pole 10 is shown in solid line in FIG. 1). An operating mechanism 15 is mounted to a front end of the housing 3. The operating mechanism 15 is common to all three circuit breaker poles 10 and is connected to the individual poles by a pole shaft 33 that has a drive lobe 35 for each pole. The drive lobe 35 is pivotally connected to a pair of carrier drive links 37 that translate motion of the drive lobe 35 into motion of pole components to separate the pole's contacts. The operating mechanism 15 includes a trip unit (not shown) that actuates the operating mechanism to open all the poles of the circuit breaker through rotation of the pole shaft 33 in response to predetermined characteristics of the current flowing through the circuit breaker. In addition, the operating mechanism 15 may be manually actuated by way of a switch lobe portion 36. The switch lobe portion 36 is connected to one or more manually operable switches (not shown) that are accessible outside the housing 3.

The pole 10, which will be described in more detail below, includes a stationary contact assembly 25 configured to be connected to a line conductor (not shown) that projects rearwardly from the housing 3. The pole 10 also includes a contact carrier 40 that is operable to carry a moveable contact assembly 45 away from the stationary contact assembly 25. The moveable contact assembly 45 includes a plurality of contact fingers 47 that are pivotally mounted to the contact carrier 40. When the circuit breaker is closed, the moveable contact assembly 45 provides a current path between the stationary contact assembly 25 and a load conductor connector assembly 65 configured to be connected to a load conductor (not shown). The current path includes a stationary contact 27, a moveable contact 42 and a flexible shunt (not shown) connected to bottom end 49 shunt connection feature (FIG. 5) of the contact fingers 47. A moving seal 50 is also pivotally mounted to the contact carrier 40. The moving seal 50 includes a sealing surface 52 that forms one portion of a sealed arc chamber (not visible in FIG. 1, see FIGS. 5-7).

Figure 7:
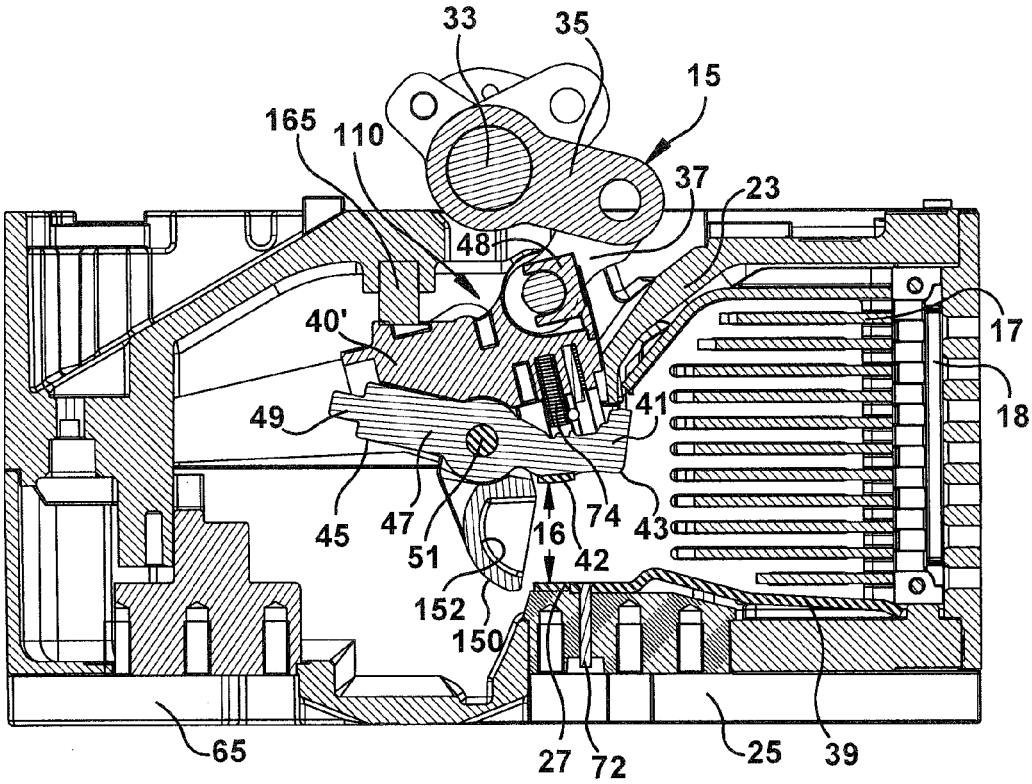
FIG. 7 is a cross section of the air circuit breaker taken along 5-5 as indicated in FIG. 4 with a pole assembly in an open or non-conducting position.

The carrier drive links 37 connect to a carrier housing 46 that houses various components of the contact carrier 40 and co-acts with the moveable contact assembly 45 to open and close the contacts, as will be described in more detail below. A clearance opening 46*a* (FIG. 2) is typically present in the carrier housing 46 to provide clearance for installation of the carrier drive link 37 into the carrier housing. According one embodiment of the present invention, an insulator plug 48 is pressed into the clearance opening 46*a* in the carrier housing 46 to insulate the carrier drive links 37 from arcing that occurs in the arc chamber. As can be seen best in FIG. 5, a front surface of the carrier housing 46 is positioned within the arc chamber when the contacts 27, 42 are closed and moves out of the arc chamber when the contacts open as shown in FIG. 7. Because the carrier drive links 37 connect to the front carrier housing 46, without the plug 48 the carrier drive links would be exposed to the arc chamber when the contacts first open, providing an arc path and possible short circuit to the pole shaft 33.

Figure 2A:
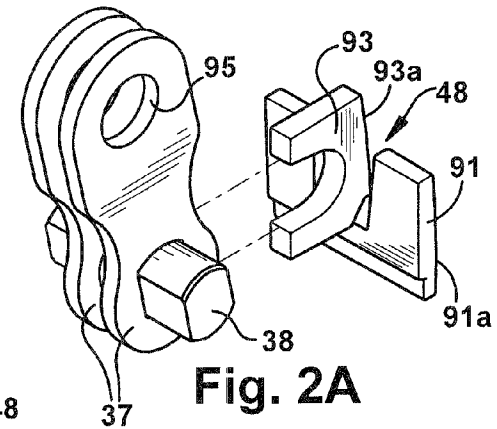
FIGS. 2 and 2A are exploded views of carrier components for one pole of the three pole air circuit breaker shown in FIG. 1.
Figure 2:
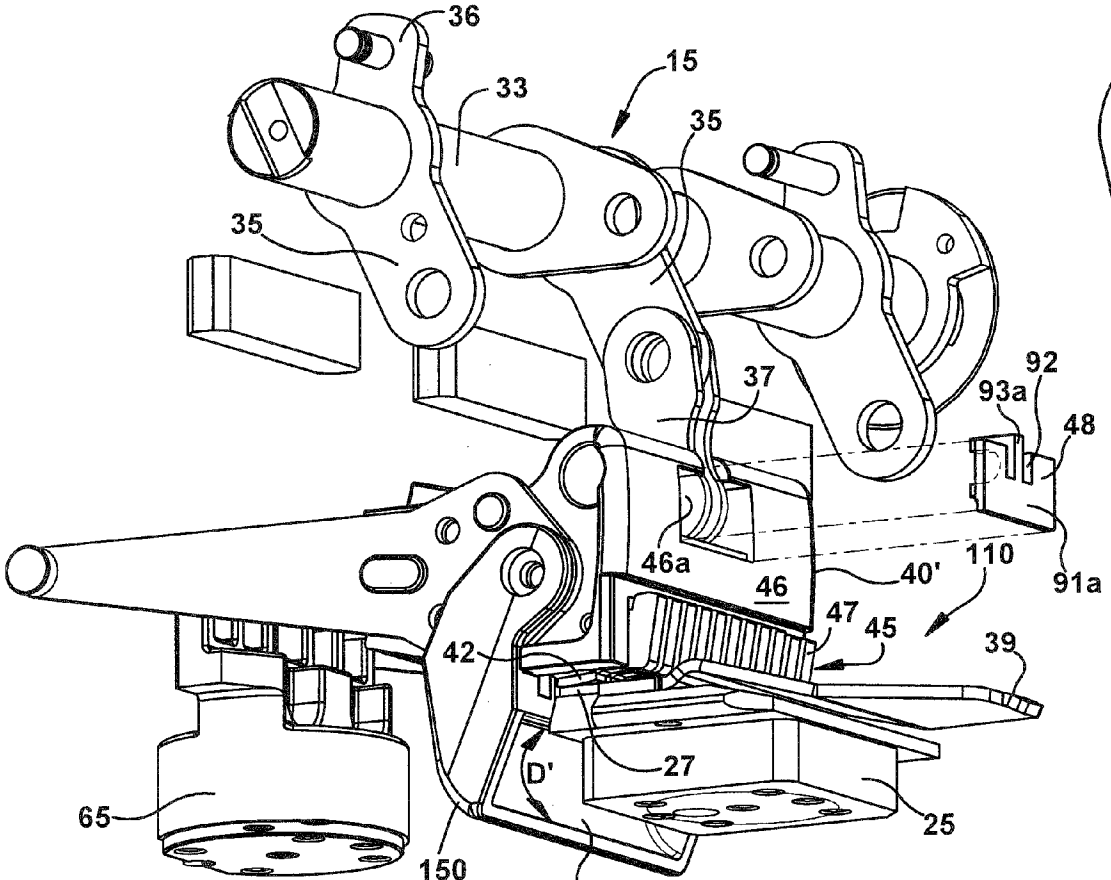

FIGS. 2 and 2A illustrate a circuit breaker pole 110 with the insulator plug 48 a carrier drive links 37 shown separately. The carrier drive links 37 are connected to one another by way of a key rod 38 that is inserted through corresponding key openings in the drive lines. The carrier drive links 37 pivotally connect to the drive lobe 35 with a pin (not shown) inserted through top openings 95. The insulator plug includes a notched flat front portion 91 having a notch 92 and a U-shaped portion 93. The U-shaped portion 93 is positioned midway within the notch 92 and projects rearward from the flat front portion 91. The flat front portion 91 is configured to be press fit into the clearance opening 46*a* once the carrier drive links 37 are installed in the carrier housing 46. The U-shaped portion 93 is configured to be positioned between the carrier drive links 37 and to surround the key rod 38. The U-shaped portion 93 includes a front face 93*a* that is coplanar with a front face of the flat front portion 91. The insulator plug 48 may be molded as a single piece from an insulating material that provides sufficient heat resistance. In one embodiment, the insulator plug is molded of glass filled polyester.

Figure 3:
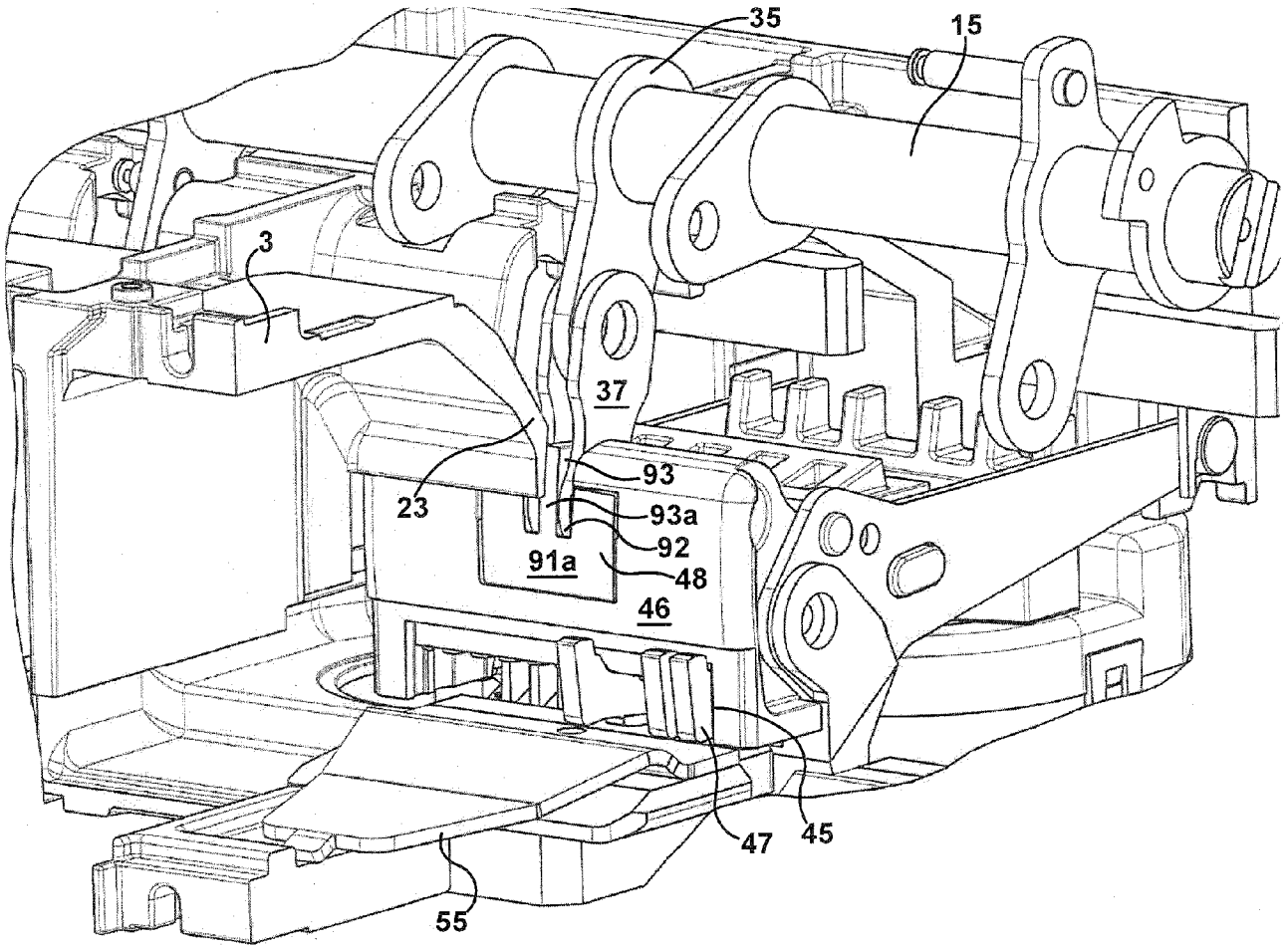
FIG. 3 is a cutaway perspective view of the three pole air circuit breaker shown in FIG. 1 that reveals the carrier components for one pole of the breaker in the breaker housing.

Referring now to FIG. 3, when the insulator plug 48 is installed in the carrier housing 46, the front face 91*a* and the front face 93*a* are aligned flush with a front face of the carrier housing 46 so that the insulator plug 48 does not interfere with normal operation of the circuit breaker. Clearance between the U-shaped portion 91 and the notch 92 provides clearance for the carrier drive links 37. The U-shaped portion 93 extends above the flat front portion 91 so that the flat front portion 93*a* abuts a portion on the circuit breaker housing 23 that forms part of the arc chamber (see FIGS. 5-7) when the contacts are closed. As will be seen in FIGS. 5-7, throughout the range of motion of the contact carrier 40, the circuit breaker housing 23 will press the insulator plug 48 into the carrier housing 46 should it move out of flush with the carrier housing.

Figure 4:
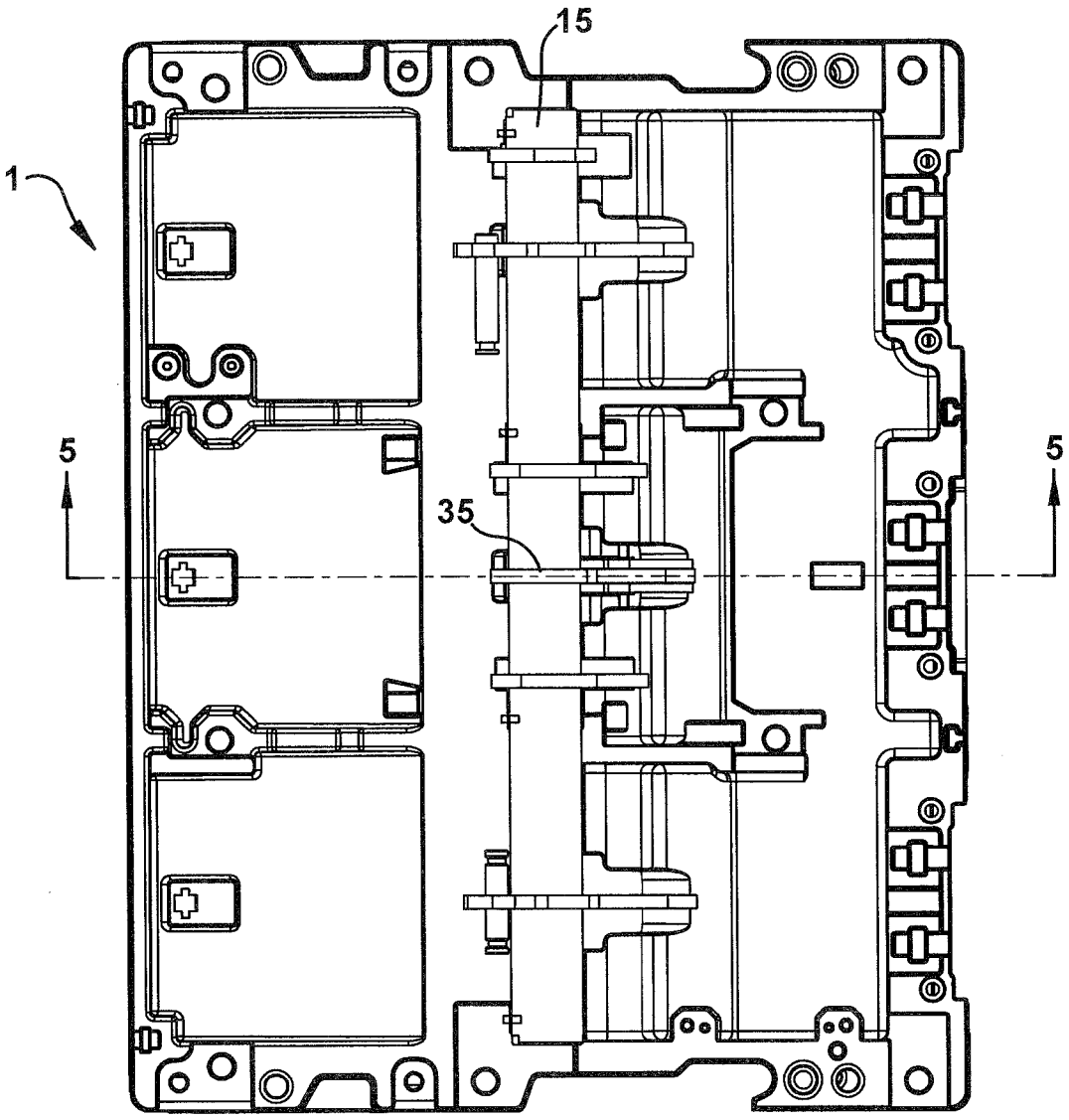
FIG. 4 is a front view of a three pole air circuit breaker that includes the pole shown in FIG. 1 and that indicates a cross section to be shown in FIGS. 5-7.
Figure 5:
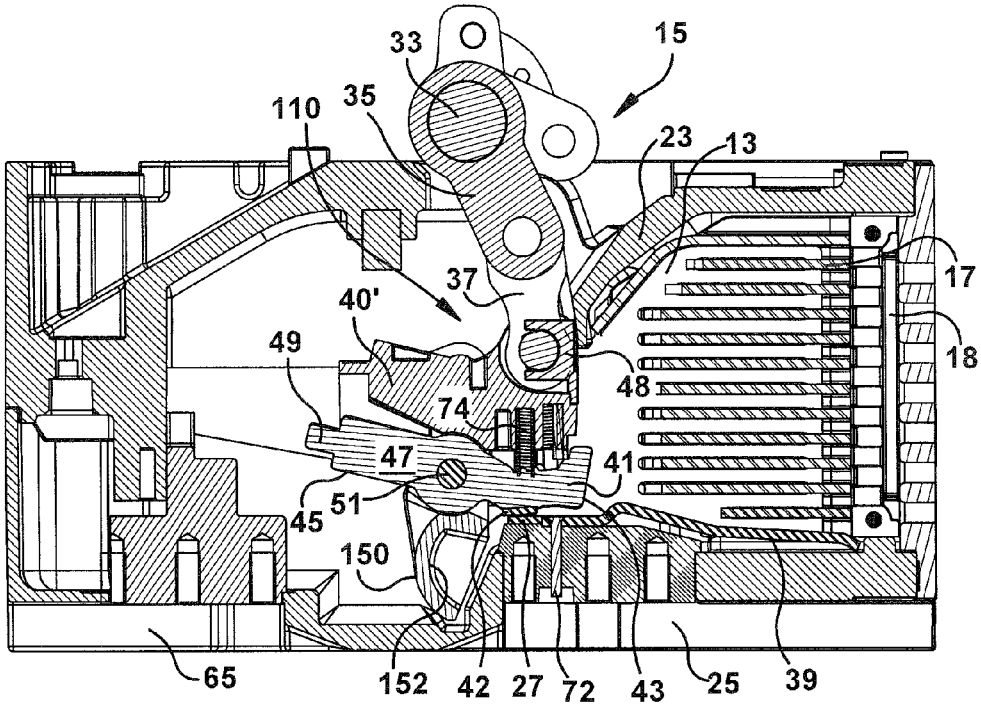
FIG. 5 is a cross section of the air circuit breaker taken along 5-5 as indicated in FIG. 4 with a pole assembly in a closed or conducting position.

FIG. 4 is a front view of the air circuit breaker 1. Section 5-5 is indicated in FIG. 4 and will be used for the cross section views of a pole 110 shown in FIGS. 5-7. Referring now to FIG. 5, the pole 110 can be seen positioned within an arc chamber 13. The arc chamber, which is substantially closed to so that it can be pressurized, includes an outlet 18 through which arc gases may pass. In FIG. 5 the pole 110 is in a closed position so that current may be conducted from the stationary contact assembly 25 to the load connector assembly 65. The contact fingers 47 on the moveable contact assembly 45 are positioned so that the moveable contacts 42 abut the stationary contacts 27. Springs 74 urge the contact fingers 47 into the closed position. The insulator plug 48 is position partially within the arc chamber 13. The flat front portion 91 is within the arc chamber while the U shaped portion 93 is only partially within the arc chamber. A top portion of the U shaped portion front face 93*a* abuts and may contact the circuit breaker housing 23.

The moveable contacts 42 are fixed to the contact fingers 47 about midway between the pivot pin 51 and a first or free end 41. A shunt connection feature 49 on the contact fingers 47 is adapted to be connected to a flexible shunt (not shown) that connects the contact fingers 47 to the load conductor connector assembly 65. Adjacent to the free end 41 of the contact fingers is an arc toe 43 that forms a moveable arcing contact which cooperates with an arc runner 39 to guide the arc from into an arc chute 17 in the arc chamber 13 to be extinguished. The moving seal 150 is also pivotally mounted to the pivot pin 51 on the contact carrier 40. In the closed position, the moving seal 150 is positioned down below the stationary contact 27.

Figure 6:
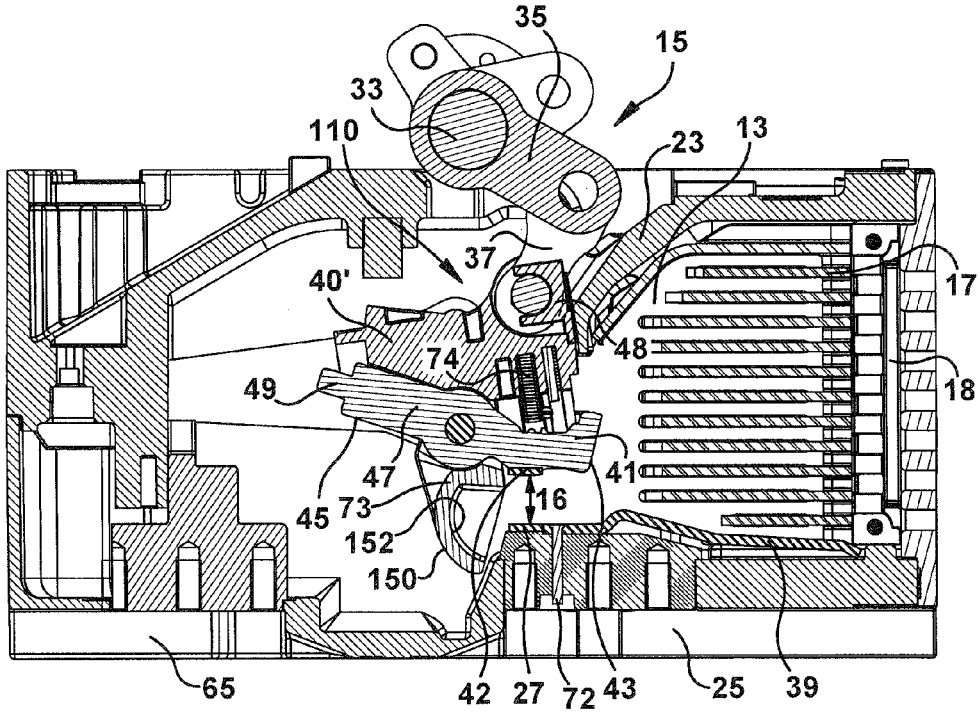
FIG. 6 is a cross section of the air circuit breaker taken along 5-5 as indicated in FIG. 4 with a pole assembly in an intermediate contact separation position.

FIG. 6 illustrates the circuit breaker pole 110 as it begins to open in response to rotation of the shaft 33 that acts upon the linkage between the drive lobe 35 and the carrier drive link 37 to rotate the contact carrier 40. An arc chamber inlet 16 is created by the movement of the contact carrier 40. The contact carrier 40 begins to rotate counter clockwise and the springs 74 rock the contact fingers 47 clockwise so that arc toe 43 contacts the arc runner while the moveable contacts 42 are separated from the stationary contact 27. The insulator plug 48 is moving so that will no longer be positioned within the arc chamber 13. Any arcing that occurs during contact separation will be prevented from contacting the carrier drive links 37 by the insulator plug. The flat front portion 91 and the U shaped portion front face 93*a* abut and may contact the circuit breaker housing 23.

Continued rotation of the contact carrier causes the moving seal 150 rotate up toward the stationary contacts 27 to the position shown in FIG. 7. The moving seal 150 is positioned to seal between the contact fingers 47 and to place the arc creepage surface 152 just below the stationary contact 27 to close off the arc chamber inlet 16 so that the arc can be extinguished. The insulator plug 48 is positioned outside the arc chamber 13. The flat front portion 91*a* and the U shaped portion front face 93*a* abut and may contact the circuit breaker housing 23.

Figure 8:
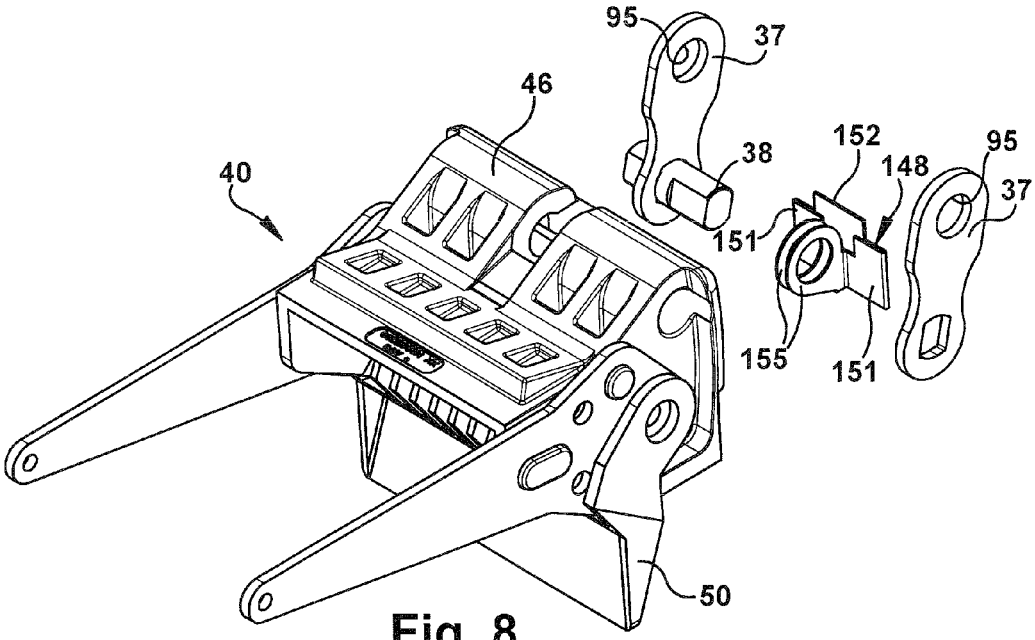
FIGS. 8 and 8A illustrate are fragmentary perspective views of a three pole air circuit breaker that includes another embodiment of a carrier link insulator.
Figure 8A:
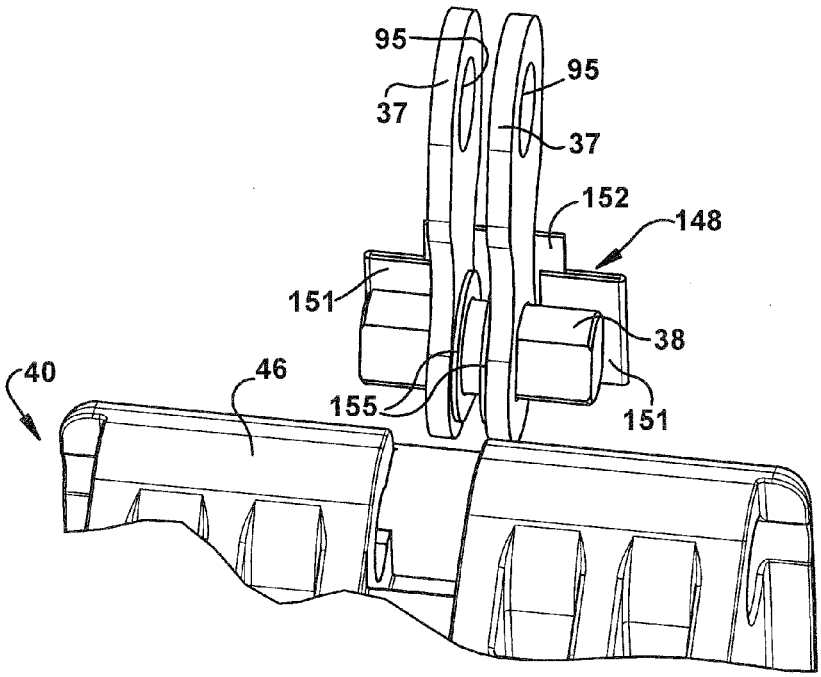

FIGS. 8 and 8A illustrate an alternative embodiment of a carrier link insulator 148. The carrier link insulator 148 includes a pair of barrier clips 151 that secure a flexible barrier member 152. The barrier clips 151 each have a ring tab 155 that is configured to surround the key rod 38 between the drive links 37 to couple the insulator 148 to the drive links. The barrier 152 is made of a dielectric material such as fish paper and is configured to flex when the drive links 37 move the contact carrier 40 along the excursion between the contact closed and contact open positions.

To the extent that the term "or" is employed in the detailed description or claims (e.g., A or B) it is intended to mean "A or B or both". The term "and/or" is used in the same manner, meaning "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

To the extent that the phrase "one or more of, A, B, and C" is employed herein, (e.g., a data store configured to store one or more of, A, B, and C) it is intended to convey the set of possibilities A, B, C, AB, AC, BC, and/or ABC (e.g., the data store may store only A, only B, only C, A&B, A&C, B&C, and/or A&B&C). It is not intended to require one of A, one of B, and one of C. When the applicants intend to indicate "at least one of A, at least one of B, and at least one of C", then the phrasing "at least one of A, at least one of B, and at least one of C" will be employed.

What is claimed is:

1. An apparatus comprising:

a contact carrier configured to be actuated by a carrier drive link to carry one or more moveable contacts along an excursion between a contact closed position in which the moveable contacts electrically contact corresponding stationary contacts and a contact open position in which the moveable contacts do not contact the corresponding stationary contacts, the contact carrier comprising:

a carrier housing configured to house the carrier drive link, the carrier housing further comprising a front face that is positioned within an arc chamber during at least a portion of the carrier excursion: and a carrier link insulator coupled to the carrier housing, the carrier link insulator comprising an electrically insulating material and being located in an arc path between the arc chamber and the carrier drive link, where the carrier link insulator comprises an insulator plug configured to be press fit in an opening in the carrier housing front face, where the insulator plug comprises a plug front face that is substantially flush with the carrier housing front face when the insulator plug is fitted into the carrier housing, and where the insulator plug comprises:

notched flat front portion;

a U-shaped portion;

where the U-shaped portion is positioned midway within a notch in the notched flat front portion; and where the U-shaped portion is configured to be positioned around at least a portion of the carrier drive link.

2. The apparatus of claim 1 where the U-shaped portion comprises a front face that aligns flush with a front face of the notched flat front portion to form the plug front face.

3. The apparatus of claim 2 where the front face of the U-shaped portion extends above the front face of the notched flat front portion such that the plug front face abuts a circuit breaker housing the forms part of the arc chamber throughout the excursion.

4. The apparatus of claim 1 where the carrier link insulator comprises a flexible barrier comprised of dielectric material coupled to the carrier drive link and configured to flex when the carrier drive link moves the contact carrier.

5. A circuit breaker comprising:

a substantially closed arc chamber enclosing a pair of separable contact assembles comprising a moveable contacts and a stationary contact, where a portion of the arc chamber is formed by a circuit breaker housing; and a contact carrier coupled to a carrier drive link, the contact carrier configured to carry the moveable contact along an excursion between a contact closed position in which the moveable contact electrically contacts the stationary contact and a contact open position in which the moveable contact does not contact the corresponding stationary contact, the contact carrier comprising;

a carrier housing configured to house the carrier drive link, the carrier housing further comprising a front face that is positioned within an chamber during at least a portion of the carrier excursion; and a carrier link insulator coupled to the carrier housing, the carrier link insulator comprising an electrically insulating material and being located in an arc path between the arc chamber and the carrier drive link, where the carrier link insulator comprises an insulator plug configured to be press fit in an opening in the carrier housing front face, where the insulator plug comprises a plug front face that is substantially flush with the carrier housing front face when the insulator plug is fitted into the carrier housing, and where the insulator plug comprises:

notched flat front portion;

a U-shaped portion;

where the U-shaped portion is positioned midway within a notch in the notched flat front portion; and where the U-shaped portion is configured to be positioned around at least a portion of the carrier drive link.

6. The circuit breaker of claim 5 where the U-shaped portion comprises a front face that aligns flush with a front face of the notched flat front portion to form the plug front face.

7. The circuit breaker of claim 6 where the front face of the U-shaped portion extends above the front face of the notched flat front portion such that the plug front face abuts a circuit breaker housing the forms part of the arc chamber throughout the excursion.

8. The circuit breaker of claim 5 where the carrier link insulator comprises a flexible barrier comprised of dielectric material coupled to the carrier drive link and configured to flex when the carrier drive link moves the contact carrier.

* * * * *